US009847207B2

(12) United States Patent
Tezuka et al.

(10) Patent No.: US 9,847,207 B2
(45) Date of Patent: Dec. 19, 2017

(54) X-RAY TUBE ASSEMBLY

(71) Applicant: Toshiba Electron Tubes & Devices Co., Ltd., Otawara-shi (JP)

(72) Inventors: Masahiko Tezuka, Otawara (JP); Hidero Anno, Otawara (JP)

(73) Assignee: Toshiba Electron Tubes & Devices Co., Ltd., Otawara-shi (JP)

( * ) Notice: Subject to any disclaimer, the term of this patent is extended or adjusted under 35 U.S.C. 154(b) by 59 days.

(21) Appl. No.: 14/959,652

(22) Filed: Dec. 4, 2015

(65) Prior Publication Data

US 2016/0172149 A1 Jun. 16, 2016

(30) Foreign Application Priority Data

Dec. 16, 2014 (JP) ..... 2014-253840
Jan. 9, 2015 (JP) ..... 2015-003235
Mar. 26, 2015 (JP) ..... 2015-064432

(51) Int. Cl.
*H01J 35/30* (2006.01)
*H01J 35/14* (2006.01)
*H01J 35/06* (2006.01)
*H05G 1/02* (2006.01)

(52) U.S. Cl.
CPC ..... *H01J 35/30* (2013.01); *H01J 35/06* (2013.01); *H01J 35/14* (2013.01); *H05G 1/025* (2013.01)

(58) Field of Classification Search
CPC .. H01J 35/16; H01J 35/14; H01J 35/06; H01J 35/08; H01J 35/30; H01J 2235/163; H01J 2235/06; H01J 2235/1216; H01J 2237/152; A61N 2005/1022
USPC ..... 378/119
See application file for complete search history.

(56) References Cited

U.S. PATENT DOCUMENTS 4,689,809 A 8/1987 Stohval
5,812,632 A 9/1998 Schardt et al.
6,529,579 B1 3/2003 Richardson
6,977,991 B1 12/2005 Neumeier et al.
7,289,603 B2 10/2007 Andrews et al.
(Continued)

FOREIGN PATENT DOCUMENTS

CN 101449352 A 6/2009
CN 102473574 A 5/2012
JP 2008-159317 A 7/2008
(Continued)

OTHER PUBLICATIONS

Combined Office Action and Search Report dated May 3, 2017 in Chinese Patent Application No. 201510926764.8 (with English language translation).

*Primary Examiner* — Don Wong
(74) *Attorney, Agent, or Firm* — Oblon, McClelland, Maier & Neustadt, L.L.P.

(57) ABSTRACT

According to one embodiment, an X-ray tube assembly includes a cathode includes a first non-magnetic metal member having high electrical conductivity, an anode target includes a second non-magnetic metal member having high electrical conductivity, a vacuum envelope having depressed portion depressed, and a first magnetic deflector provided outside the vacuum envelope, includes first magnetic pole pair generating the alternating magnetic field, the first magnetic pole pair being provided in close vicinity to a wall surface of the depressed portion.

6 Claims, 8 Drawing Sheets

(56) References Cited

U.S. PATENT DOCUMENTS 8,761,343 B2 * 6/2014 Jeong ..... H01J 35/065
378/121

FOREIGN PATENT DOCUMENTS

| | | | |
|---|---|---|---|
| JP | 2010-21010 | A | 1/2010 |
| JP | 2010-27446 | A | 2/2010 |
| JP | 2010-27448 | A | 2/2010 |
| JP | 2010-80399 | A | 4/2010 |
| JP | 5216506 | | 6/2013 |
| WO | WO 2014/064748 | A1 | 5/2014 |

* cited by examiner

X-RAY TUBE ASSEMBLY

CROSS-REFERENCE TO RELATED APPLICATIONS

This application is based upon and claims the benefit of priority from Japanese Patent Applications No. 2014-253840, filed Dec. 16, 2014; No. 2015-003235, filed Jan. 9, 2015; and No. 2015-064432, filed Mar. 26, 2015, the entire contents of all of which are incorporated herein by reference.

FIELD

Embodiments described herein relate generally to an X-ray tube assembly.

BACKGROUND

A rotary-anode X-ray tube assembly is a device which urges electrons generated from a cathode electron emission source to collide with a rotating anode target to generate X-rays at an X-ray focus formed due to the collision of the electrons with the anode target. In general, the rotary-anode X-ray tube assembly is employed in an X-ray CT device or the like.

In a flying-focus (focal position shift) X-ray CT device, an X-ray focus is arranged at different positions during photography using X-rays by the rotary-anode X-ray tube assembly, and an angle of incidence of the X-rays incident on a detector through a subject is slightly varied. It is known that the resolution property of the X-ray photographic image is consequently improved. To thus arrange the X-ray focus at different positions by the rotary-anode X-ray tube assembly during the X-ray photography, the X-ray focus needs to be finely moved intermittently, continuously and periodically, in a short time of 1 msec or less.

Several systems for finely moving the X-ray focus in a short time are known. One of them is a magnetic electron beam change which deflects the electron beam by the deflecting magnetic field in which a magnetic pole is generated. In the magnetic electron beam deflection, a small-diameter portion is provided in a vacuum envelope located between the cathode and the anode target, and magnetic poles are arranged in the portion to generate the deflecting magnetic field. In a constitution of the magnetic electron beam deflection, a distance between the magnetic poles arranged in the small-diameter portion becomes short, a magnetic flux density can be increased at the electron beam position and an electron orbital can be certainly deflected.

Since the small-diameter portion is formed in the vacuum envelope, the cathode is arranged remote from the anode target, in the rotary-anode X-ray tube assembly. In addition, since the small-diameter portion is formed, a potential distribution is varied and the electron beam can hardly be converged. As a result, expansion, blur, and distortion of the X-ray focus, reduction in the electron emission quantity of the cathode, etc., may occur.

Thus, the object of the embodiments is to provide a rotary-anode X-ray tube assembly capable of certainly deflecting the electron orbital forwarding from the cathode to the anode target without forming the small-diameter portion in the vacuum envelope, and of suppressing occurrence of the expansion, blur, and distortion of the X-ray focus, reduction in the electron emission quantity of the cathode, etc.

DETAILED DESCRIPTION

In general, according to one embodiment, an X-ray tube assembly, comprises: a cathode emitting an electron and comprising at least a surface portion formed of a first non-magnetic metal member having high electrical conductivity; an anode target comprising at least a surface portion formed of a second non-magnetic metal member having high electrical conductivity, being provided to be opposed to the cathode, and comprising a target surface from which X rays are generated by allowing the electron emitted from the cathode to collide with the target surface; a vacuum envelope containing the cathode and the anode target, having an interior sealed in vacuum airtight state, and having at least one depressed portion depressed from outside formed to sandwich the cathode from both sides; and a first magnetic deflector supplied with an AC current from a power supply, provided outside the vacuum envelope, comprising at least one first magnetic pole pair composed of two paired magnetic poles generating the alternating magnetic field, and generating an alternating magnetic field for deflecting an electron orbital of the electron emitted from the cathode toward the anode target, between the cathode and the anode target, by the first magnetic pole pair, the first magnetic pole pair being provided in close vicinity to a wall surface of the depressed portion so as to sandwich the cathode.

An X-ray tube assembly of embodiments will be described hereinafter with reference to the accompanying drawings.

First Embodiment

Figure 1:
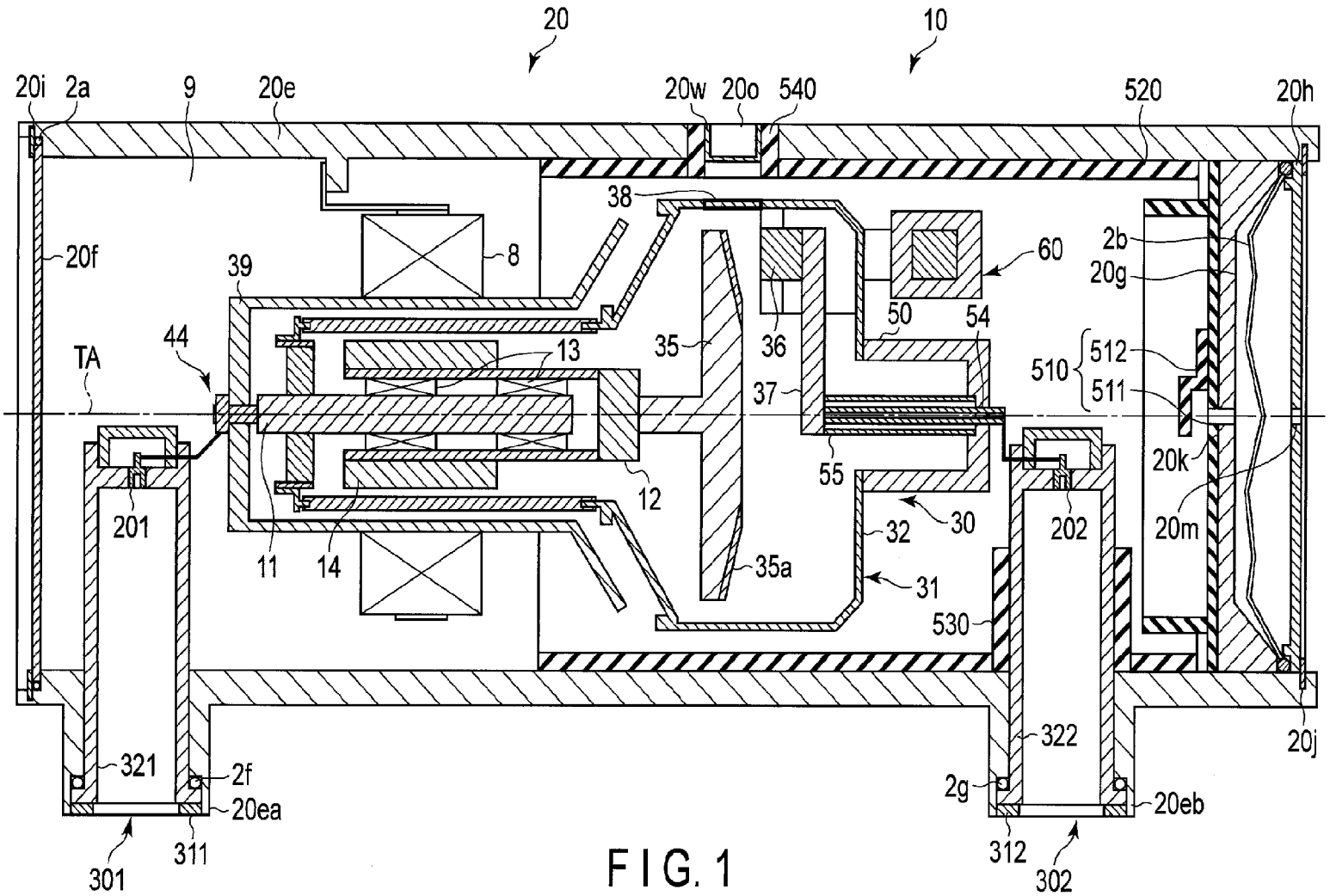
FIG. 1 is a cross-sectional view showing an example of an X-ray tube assembly of a first embodiment.

FIG. 1 is a cross-sectional view showing an example of an X-ray tube assembly 10 of the first embodiment As shown in FIG. 1, roughly, the X-ray tube assembly 10 comprises a stator coil 8, a housing 20, an X-ray tube 30, a high-voltage insulating member 39, a first magnetic deflector 60, receptacles 301 and 302, and X-ray shielding members 510, 520, 530 and 540. For example, the X-ray tube assembly 10 is a rotary-anode X-ray tube assembly. The X-ray tube 30 is, for example, a rotary-anode X-ray tube. For example, the X-ray tube 30 is a neutral-grounding-type rotary-anode X-ray tube. Each of the X-ray shielding members 510, 520, 530, and 540 is formed of lead.

In the X-ray tube assembly 10, a space formed between an inside of the housing 20 and an outside of the X-ray tube 30 is filled with an insulating oil 9 serving as a coolant. For example, the X-ray tube assembly 10 is configured to circulate the insulating oil 9 by a circulation cooling system (cooler) (not shown) connected with the housing 20 by hoses (not shown) and cool the insulating oil 9. In this case, the housing 20 comprises an intake port and a discharge port of the insulating oil 9. The circulation cooling system comprises, for example, a cooler which radiates heat from the insulating oil 9 in the housing 20 and circulates the insulating oil 9, conduits (hoses or the like) which communicates the cooler with the intake port and a discharge port of the housing 20 airtightly and liquid-tightly. The cooler comprises a circulating pump and a heat exchanger. The circulating pump discharges the insulating oil 9 heat exchanger taken in from the housing 20 side into the heat exchanger and produces a flow of the insulating oil 9 in the housing 20. The heat exchanger is made to communicate with an interval between the housing 20 and the circulating pump and to discharge the heat of the insulating oil 9 to the outside.

A detailed configuration of the X-ray tube assembly 10 will be explained hereinafter with reference to the drawings.

The housing 20 comprises a cylindrically shaped housing body 20*e* and lid portions (side plates) 20*f*, 20*g* and 20*h*. The housing body 20*e*, and the lid portions 20*f*, 20*g* and 20*h* are formed of casting using aluminum. If they are formed of a resin material, a portion such as a screw portion, which needs to have much strength, a portion which is hard to form by injection molding using resin, a shielding layer (not shown) which prevents leakage of electromagnetic noise from the housing 20 to the outside, etc., may be formed in part of metal together with the resin material. A center axis passing through a cylindrical center of the housing body 20*e* is referred to as a tube axis TA.

An annular stepped portion is formed as an inner peripheral surface thinner than the housing body 20*e*, at an opening portion of the housing 20*e*. An annular groove portion is formed along the inner periphery of the stepped portion. The groove portion of the housing body 20*e* is formed by cutting the body from the step of the stepped portion to a position of a predetermined length in the outside direction along the tube axis TA. The predetermined length is, for example, substantially equal to the thickness of a lid portion 20*f*. A C-type retaining ring 20*i* is fitted in the groove portion of the housing body 20*e*. In other words, the opening portion of the housing body 20*e* is liquid-tightly closed by the lid portion 20*f*, the C-type retaining ring 20*i*, etc.

The lid portion 20*f* is formed in a disc shape. On the lid portion 20*f*, a rubber member 2*a* is provided along the outer peripheral portion, which is fitted in the stepped portion formed at the opening portion of the housing body 20*e*.

The rubber member 2*a* is formed in a shape of, for example, an O-ring. As explained above, the rubber member 2*a* is provided between the housing body 20*e* and the lid portion 20*f* to liquid-tightly seal an interval between the housing body 20*e* and the lid portion 20*f*. A peripheral portion of the lid portion 20*f* is in contact with the stepped portion of the housing body 20*e*, in a direction along the tube axis TA of the X-ray tube assembly 10.

A C-type retaining ring 20*i* is a fixing member. The C-type retaining ring 20*i* is fitted in the groove portion of the housing body 20*e* and fixes the lid portion 20*f* as explained above, to restrict movement of the lid portion 20*f* in the direction along the tube axis TA.

The lid portions 20*g* and 20*h* are fitted in an opening portion opposite to the opening portion of the housing body 20*e* in which the lid portion 20*f* is provided. In other words, the lid portions 20*g* and 20*h* are provided to be parallel to the lid portion 20*f* and to be opposed to each other, at the end portion on the side opposite to the end portion of the housing body 20*e* at which the lid portion 20*f* is provided. The lid portion 20*g* is liquid-tightly fitted at a predetermined position inside the housing body 20*e*. At the end portion of the housing body 20*e* at which the lid portion 20*h* is provided, an annular groove portion is formed on an inner peripheral portion on the outer side adjacent to the position at which the lid portion 20*h* is provided. A rubber member 2*b* is extensibly provided between the lid portions 20*g* and 20*h* to maintain the liquid-tight condition. The lid portion 20*h* is provided on an outer side than the lid portion 20*g*, in the housing body 20*e*. The C-type retaining ring 20*i* is fitted in the groove portion formed in close vicinity to the position at which the lid portion 20*h* is provided. In other words, the opening portion of the housing body 20*e* is liquid-tightly closed by the lid portions 20*g* and 20*h*, the C-type retaining ring 20*i*, the rubber member 2*b*, etc.

The lid portion 20*g* is formed in a circular shape having substantially the same diameter as a diameter of the inner periphery of the housing body 20*e*. The lid portion 20*g* includes an opening portion 20*k* for intake or discharge of the insulating oil 9.

The lid portion 20*h* is formed in a circular shape having substantially the same diameter as the inner periphery of the housing body 20*e*. A vent hole 20*m* through which air serving as an atmosphere comes in and goes out is formed in the lid portion 20*h*.

The C-type retaining ring 20*j* is a fixing member which holds the state of the lid portion 20*h* clamped to a peripheral portion (sealing portion) of the rubber member 2*b*.

The rubber member 2*b* is a rubber bellows (rubber film). The rubber member 2*b* is formed in a circular shape. The peripheral portion (sealing portion) of the rubber member 2*b* is formed in a shape of an O-ring. The rubber member 2*a* is provided between the housing body 20*e* and the lid portions 20*g* and 20*f* to liquid-tightly seal them. The rubber member 2*b* is provided on the inner periphery of the end portion of the housing body 20*e*. In other words, the rubber member 2*b* is provided to divide a space of a certain part in the housing. In the present embodiment, the rubber member 2*a* is provided in a space surrounded by the lid portions 20*g* and 20*h* to liquid-tightly divide the space. The space on the lid portion 20*g* side is called a first space and the space on the lid portion 20*h* side is called a second space. The first space communicates with the space inside the housing 20*e* which is filled with the insulating oil 9 through the opening portion 20*k*. For this reason, the first space is filled with the insulating oil 9. The second space communicates with the outer space through the vent hole 20*m*. For this reason, the second space is an air atmosphere.

An opening portion 20*o* is formed in the housing body 20*e*. An X-ray radiation window 20*w* and an X-ray shielding portion 540 are provided at the opening portion 20*o*. The opening portion 20*o* is liquid-tightly closed by the X-ray radiation window 20*w* and the X-ray shielding portion 540. The X-ray shielding members 520 and 540 are provided to shield against the X-ray to the outside of the housing, at the opening portion 20*o*, which will be explained in detail later.

The X-ray radiation window 20*w* is formed of a member which permits X-rays to easily pass therethrough. For example, the X-ray radiation window 20*w* is formed of a metal which is highly X-ray transmissive.

The X-ray shielding members 510, 520, 530 and 540 may be formed of a radio-opaque material containing at least lead or may be formed of a lead alloy or the like.

The X-ray shielding member 510 is provided on an inner surface of the lid portion 20*g*. The X-ray shielding member 510 shields against X-rays radiated from the X-ray tube 30.

The X-ray shielding member 510 comprises a first shielding member 511 and a second shielding member 512. The first shielding member 511 is provided on an inner surface of the lid portion 20*g*. The first shielding member 511 is provided to cover the entire inner surface of the lid portion 20*g*. The second shielding member 512 is provided such that one end portion of the second shielding member 512 is stacked on the inner surface of the first shielding member 511 while the other end portion of the second shielding member 512 is arranged inside the housing body 20*e* in the direction along the tube axis TA to be spaced apart from the opening portion 20*k*. In other words, the second shielding member 512 is provided such that the insulating oil 9 comes in and goes out through the opening portion 20*k*.

The X-ray shielding member 520 is formed in a substantially cylindrical shape. The X-ray shielding member 520 is provided at a part of the inner peripheral portion of the housing body 20*e*. One of end portions of the X-ray shielding member 520 is in close vicinity to the first shielding member 511. For this reason, the X-ray shielding members 510 and 520 can shield against X-ray leakage from the gap between the X-ray shielding members 510 and 520 to the outside of the housing. The X-ray shielding member 520 extends from the first shielding member 511 to a vicinity of the stator coil 8 along the tube axis. The X-ray shielding member 520 is fixed to the housing 20 as needed.

The X-ray shielding member 530 is formed in a cylindrical shape and fitted along the outer periphery of the receptacle 302 to be explained later, inside the housing 20. The X-ray shielding member 530 is provided such that one of end portions of the cylinder is in contact with a wall surface of the housing body 20*e*. At this time, a hole through which the end portion of the X-ray shielding member 530 passes is formed in the X-ray shielding member 520. The X-ray shielding member 530 is fixed to the X-ray shielding member 520 as needed.

The X-ray shielding member 540 is formed in a frame shape and provided on a side edge of the opening portion 20*o* of the housing 20. The X-ray shielding member 540 is provided along an inner wall of the opening portion 20*o*. The end portion of the X-ray shielding member 540 inside the housing body 20*e* is in contact with the X-ray shielding member 520. The X-ray shielding member 540 is fixed to the side edge of the opening portion 20*o* as needed.

The receptacle 301 for the anode and the receptacle 302 for the cathode are connected to the housing body 20*e*. Each of the receptacles 301 and 302 is formed in a shape of a bottomed cylinder having an opening portion. In each of the receptacles 301 and 302, the bottom portion is provided inside the housing 20 while the opening portion opens to the outside. For example, the receptacles 301 and 302 are provided to be spaced apart with a predetermined interval, inside the housing body 20*e*, and their opening portions are provided to face in the same direction.

The receptacle 301 and a plug (not shown) to be inserted into the receptacle 301 are in a non-surface pressure type and formed to be detachable. A high voltage (for example, +70 to +80 kV) is supplied from the plug to a terminal 201 while the plug is coupled to the receptacle 301.

The receptacle 301 is provided on the lid portion 20*f* side in the housing 20, at a position inner than the lid portion 20*f*. The receptacle 301 comprises a housing 321 serving as an electrically insulating member and the terminal 201 serving as a high-voltage supply terminal.

The housing 321 is formed of an insulating material, for example, resin. The housing 321 is formed in a shape of a bottomed cylinder having a plug-in outlet opening to the outside. The housing 321 comprises the terminal 201 on the bottom portion. An annular protrusion is formed on the outer surface of the housing 321, at the end portion on the opening side. The protrusion of the housing 321 is formed to be fitted in a stepped portion 20*ea* which is a step formed at the end portion of the protrusion of the housing body 20*e*. The terminal 201 is liquid-tightly attached to the bottom portion of the housing 321, and penetrates the bottom portion. The terminal 201 is connected to a high-voltage supply terminal 44 to be explained later, via an insulated conductor.

In addition, a rubber member 2*f* is provided between the protrusion of the housing 321 and the housing body 20*e*. The rubber member 2*f* is provided between the protrusion of the housing 321 and the step of the stepped portion 20*ea* to liquid-tightly seal the protrusion of the housing 321 and the housing body 20*e*. In the present embodiment, the rubber member 2*f* is formed of an O-ring. The rubber member 2*f* prevents leakage of the insulating oil 9 to the outside of the housing 20. The rubber member 2*f* is formed of, for example, sulfur-vulcanized rubber.

The housing 321 is fixed by a ring nut 311. A screw groove is formed on an outer peripheral portion of the ring nut 311. For example, the outer peripheral portion of the ring nut 311 is processed as a male screw while the inner peripheral portion of the stepped portion 20*ea* is processed as a female screw. The protrusion of the housing 321 is therefore pressed against the stepped portion 20*ea* via the rubber member 2*f* by screwing the ring nut 311. As a result, the housing 321 is fixed to the housing body 20*e*.

The receptacle 302 is provided on the lid portion 20*g* side in the housing 20, at a position inner than the lid portion 20*g*. The receptacle 302 is formed to be substantially similar to the receptacle 301. The receptacle 302 comprises a housing 322 serving as an electrically insulating member and terminals 202 serving as high-voltage supply terminals.

The housing 322 is formed of an insulating material, for example, resin. The housing 322 is formed in a shape of a bottomed cylinder having a plug-in outlet opening to the outside. The housing 322 comprises the terminals 202 on the bottom portion. An annular protrusion is formed on the outer surface of the housing 322, at the end portion on the opening side. The protrusion of the housing 322 is formed to be fitted in a stepped portion 20*eb* which is a step formed at the end portion of the protrusion of the housing body 20*e*. The terminals 202 are liquid-tightly attached to the bottom portion of the housing 321, and penetrate—the bottom portion. The terminals 202 are connected to the high-voltage supply terminals 54 to be explained later, via insulated conductors.

In addition, a rubber member 2*g* is provided between the protrusion of the housing 322 and the housing body 20*e*. The rubber member 2*g* is provided between the protrusion of the housing 322 and the step of the stepped portion 20*eb* to liquid-tightly seal the protrusion of the housing 322 and the housing body 20*e*. In the present embodiment, the rubber member 2*g* is formed of an O-ring. The rubber member 2*g* prevents leakage of the insulating oil 9 to the outside of the housing 20. The rubber member 2*g* is formed of, for example, sulfur-vulcanized rubber.

The housing 322 is fixed by a ring nut 312. A screw groove is formed on an outer peripheral portion of the ring nut 312. For example, the outer peripheral portion of the ring nut 312 is processed as a male screw while the inner peripheral portion of the stepped portion 20*eb* is processed as a female screw. The protrusion of the housing 322 is therefore pressed against the stepped portion 20*eb* via the rubber member 2*g* by screwing the ring nut 312. As a result, the housing 322 is fixed to the housing body 20*e*.

Figure 2A:
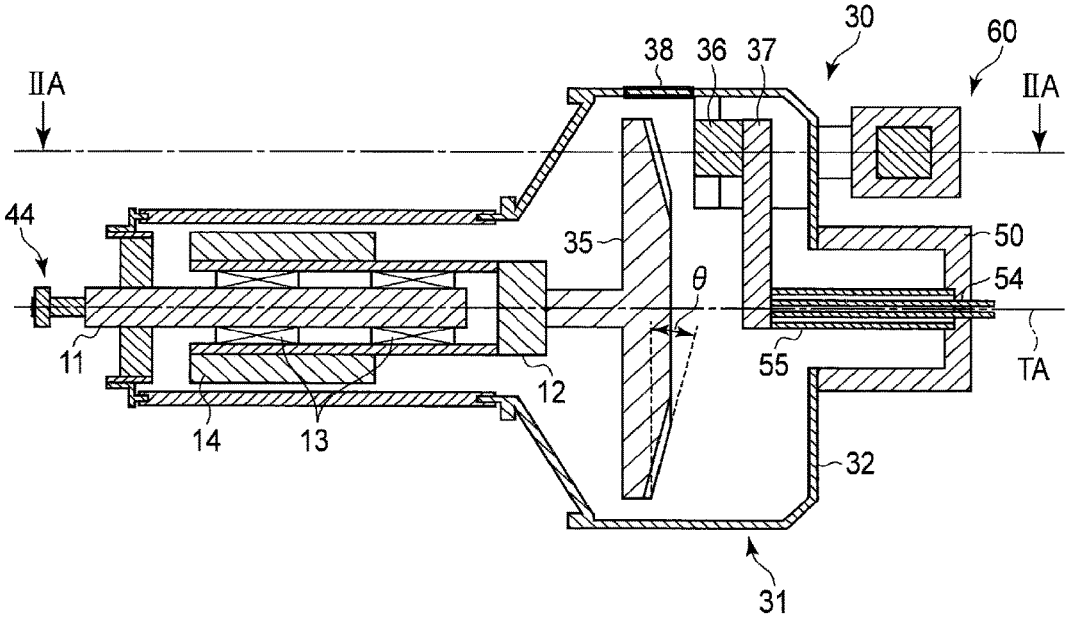
FIG. 2A is a cross-sectional view showing a summary of the X-ray tube of the first embodiment.
Figure 2B:
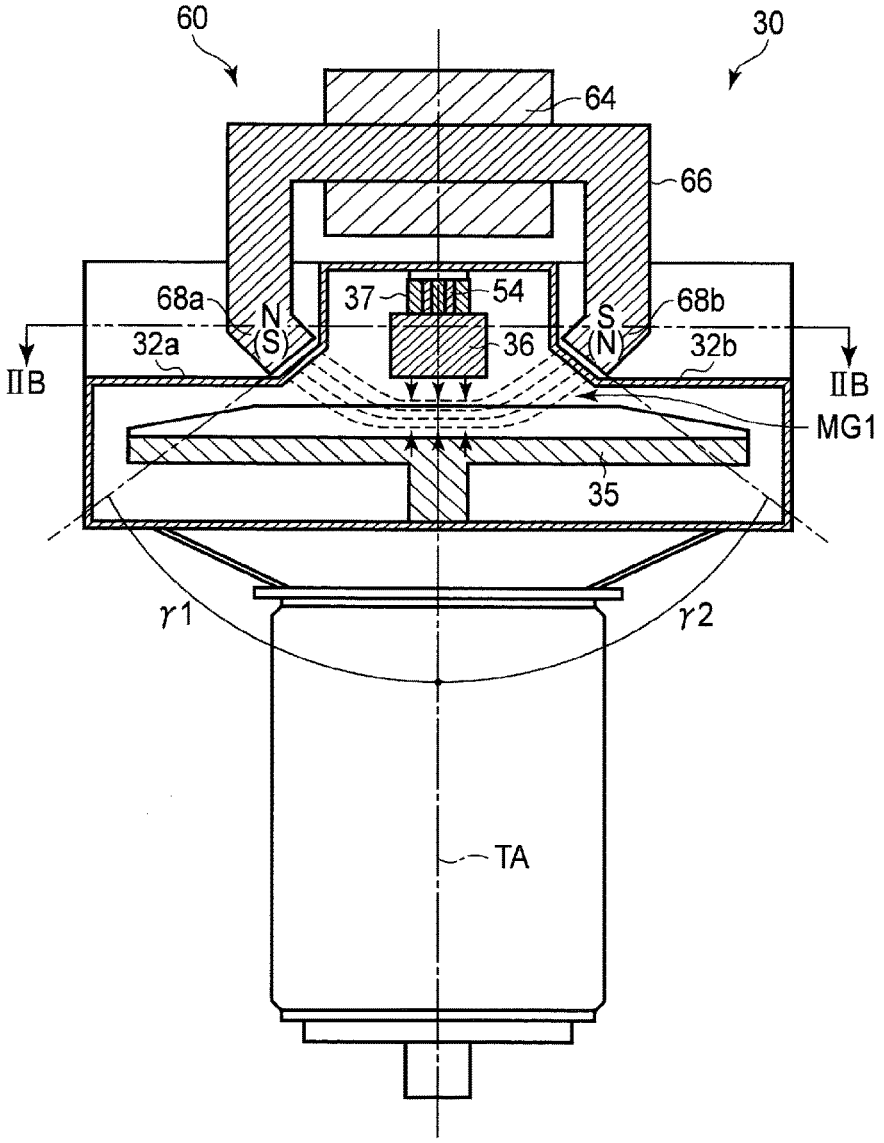
FIG. 2B is a cross-sectional view seen along line IIA-IIA in FIG. 2A.
Figure 2C:
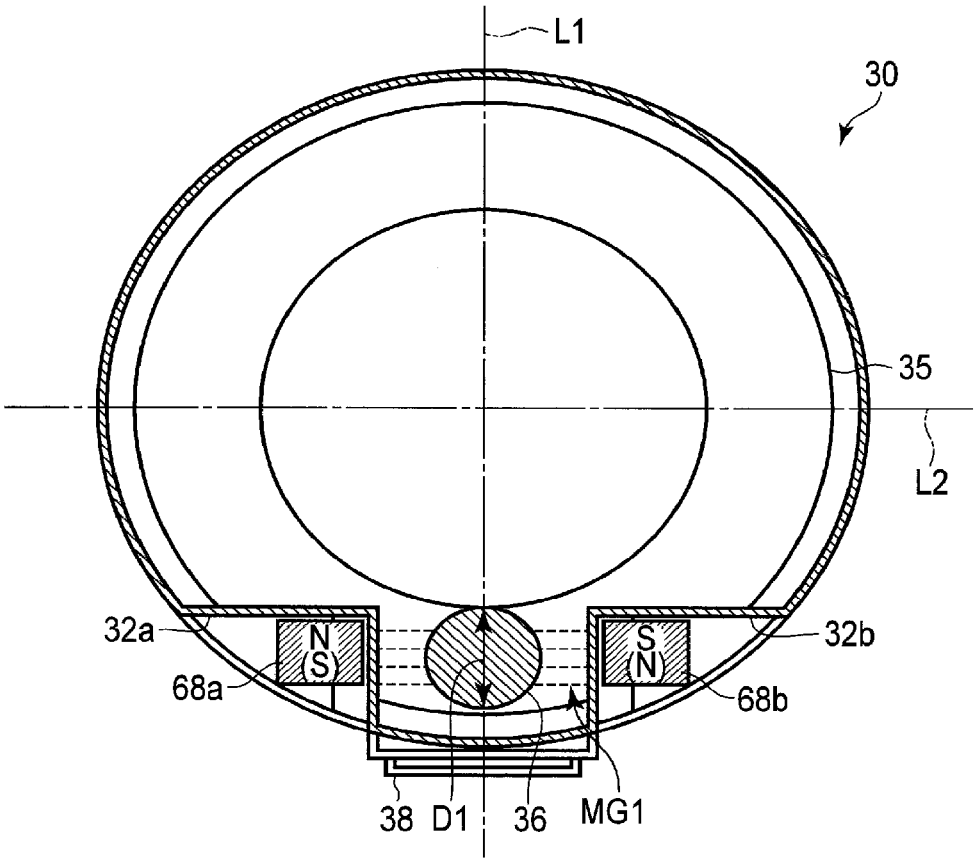
FIG. 2C is a cross-sectional view seen along line IIB-IIB in FIG. 2B.

FIG. 2A is a cross-sectional view showing a summary of the X-ray tube 30, FIG. 2B is a cross-sectional view seen along line IIA-IIA in FIG. 2A, and FIG. 2C is a cross-sectional view seen along line IIB-IIB in FIG. 2B. In FIG. 2C, a straight line orthogonal to the tube axis TA is referred to as straight line L1 and a straight line orthogonal to the tube axis TA and straight line L1 is referred to as straight line L2.

The X-ray tube 30 comprises a fixed shaft 11, a rotary body 12, bearings 13, a rotor 14, a vacuum envelope 31, an anode target 35, a cathode 36, a high-voltage supply terminal 44, high-voltage supply terminals 54, and a KOV member 55.

The fixed shaft 11 is formed in a columnar shape. The rotary body 12 is supported via the bearings 13 by the fixed shaft 11 so as to be rotatable. The fixed shaft 11 comprises a protrusion vacuum tightly attached to the vacuum envelope 31, at one of end portions. The protrusion of the fixed shaft 11 is fixed to the high-voltage insulating member 39. At this time, a distal portion of the protrusion of the fixed shaft 11 penetrates the high-voltage insulating member 39. The high-voltage supply terminal 44 is electrically connected to the distal portion of the protrusion of the fixed shaft 11.

The rotary body 12 is formed in a shape of a bottomed cylinder. The fixed shaft 11 is inserted into the rotary body 12, and the rotary body 12 is provided coaxially with the fixed shaft 11. The rotary body 12 is connected with an anode target 35 to be explained later, at the distal portion, on the bottom side, and provided to be rotatable together with the anode target 35.

The bearings 13 are provided between an inner peripheral portion of the rotary body 12 and an outer peripheral portion of the fixed shaft 11.

The rotor 14 is provided to be located inside the stator coil 8 formed in a cylindrical shape.

The high-voltage supply terminal 44 applies a relatively positive voltage to the anode target 35 via the fixed shaft 11, the rotary body 12, and the bearings 13. The high-voltage supply terminal 44 is connected to the receptacle 301, and is supplied with an electric current when a high-voltage supply source such as a plug (not shown) is connected to the receptacle 301. The high-voltage supplying terminal 44 is a metal terminal.

The anode target 35 is formed in a disc shape. The anode target 35 is coaxially connected with the rotary body 12, at the distal portion on the bottom side of the rotary body 12. For example, the central axis of the rotary body 12 and the anode target 35 is provided along the tube axis TA. In other words, the axis of the rotary body 12 and the anode target 35 is parallel to the tube axis TA. In this case, the rotary body 12 and the anode target 35 are provided to be rotatable about the tube axis.

The anode target 35 comprises an umbrella-shaped target layer 35*a* provided on a part of an outer surface of the anode target. The target layer 35*a* emits X-rays when the electrons emitted from the cathode 36 collide on the target layer 35*a*. An outer peripheral surface of the anode target 35 and a surface of the anode target 35 opposite to the target layer 35*a* are subjected to blackening treatment. The anode target 35 is formed of a non-magnetic member having high electrical conductivity. For example, the anode target 35 is formed of a non-magnetic member (second metal member) having high electrical conductivity such as copper, tungsten, molybdenum, niobium, tantalum or a non-magnetic stainless steel, titanium, chromium. The anode target 35 may have at least a surface portion formed of a non-magnetic metal member having high electrical conductivity. In addition, the anode target 35 may have the surface portion coated with a non-magnetic metal member having high electrical conductivity. As shown in FIG. 2A, an angle of a portion inclined from the outer periphery of the anode target 35 formed on the umbrella-shaped portion toward a central flat portion is represented by θ.

The cathode 36 includes a filament (electron emission source) which emits the electrons (electron beams). The cathode 36 is provided at a position opposed to the target layer 35*a*. The cathode 36 emits electrons toward the anode target 35. For example, the cathode 36 is formed in a columnar shape and emits the electrons from the filament provided at the center of the circle of the column toward the surface of the anode target 35. At this time, a straight line passing through the center of the cathode 36 is nearly parallel to the tube axis TA. A direction of the electrons emitted from the cathode 36 and an orbit of the electrons are often hereinafter explained as "an electron orbital". A relatively negative voltage is applied to the cathode 36. The cathode 36 is attached to a cathode support (cathode support or cathode supporting member) 37 to be explained later, and is connected with the high-voltage supply terminals 54 penetrating the inside of the cathode support 37. The cathode 36 is often called an electron emission source.

The cathode 36 comprises a non-magnetic cover which covers an entire body of the outer periphery. The non-magnetic cover is provided in a cylindrical shape so as to surround the cathode 36. The non-magnetic cover is formed of, for example, any one of copper, tungsten, molybdenum, niobium, tantalum and a non-magnetic stainless steel, titanium, chromium, or a non-magnetic metal member such as a metal material containing any one of them as a major component. Suitably, the non-magnetic cover is formed of a member (first metal member) having high electrical conductivity. In a case where the non-magnetic cover is arranged in an alternating magnetic field, the non-magnetic cover can generate distortion in the magnetic line of force, due to action of the alternating magnetic field in an opposite direction based on an eddy current, more strongly, when the electric conductance is high, than that when the electric conductance is low. By thus distorting the magnetic line of force, the magnetic line of force flows along the periphery of the cathode 36 and the magnetic field (alternating magnetic field) near the surface of the cathode 36 becomes strengthened. As a result, the cathode 36 can increase a force of deflecting the electrons of a first magnetic deflector 60 to be explained later. The cathode 36 may have at least the surface formed of a non-magnetic metal member having high electrical conductivity. Thus, for example, an entire body of the cathode 36 may be formed of a non-magnetic metal member having high electrical conductivity.

Furthermore, the cathode 36 comprises a non-magnetic cover surrounding the outer peripheral portion, but may be entirely formed of a non-magnetic metal or may be formed of a non-magnetic metal having high electrical conductivity, in an integrated structure.

The cathode support 37 fixes the cathode 36 at one of end portions and the KOV member 55 at the other end portion. The cathode support 37 includes the high-voltage supply terminals 54. As shown in FIG. 2A, the cathode support 37 is provided to extend from the KOV member 55 provided in the surrounding of the tube axis TA to the vicinity of the outer periphery of the anode target 35. In addition, the cathode support 37 is provided nearly parallel to the anode target 35 and spaced apart from the anode target 35 with a predetermined interval. At this time, the cathode support 37 fixes the cathode 36 at the end portion on the outer peripheral side of the anode target 35. The cathode support 37 may have the surrounding covered with a non-magnetic cover or may have at least the surface formed of a non-magnetic metal member having high electrical conductivity.

The KOV member 55 is formed of a low-thermal expansion alloy. The KOV member 55 has one of end portions fixed to the cathode support 37 and the other end portion fixed to the high-voltage insulating member 50. The KOV member 55 covers the high-voltage supply terminals 54, inside the vacuum envelope 31 to be explained later.

The high-voltage supply terminals 54 are bonded to the high-voltage insulating member 50 by brazing. The high-voltage supply terminals 54 penetrate the high-voltage insulating member 50 and is inserted into the vacuum envelope 31. At this time, the insertion portions of the high-voltage supply terminals 54 are sealed in a vacuum tight state and are inserted into the vacuum envelope 31.

The high-voltage supply terminals 54 pass through the inside of the cathode support 37 and are connected to the cathode 36. The high-voltage supply terminals 54 apply a relatively negative voltage to the cathode 36, and supply a filament current to a filament (electron emission source) (not shown) of the cathode 36. The high-voltage supply terminals 54 are connected to the receptacle 302, and are supplied with an electric current when a high-voltage supply source such as a plug (not shown) is connected to the receptacle 302. The high-voltage supply terminals 54 are metal terminals.

The vacuum envelope 31 is sealed in a vacuum atmosphere (vacuum tight) state, and contains the X-ray tube 30 comprises the fixed shaft 11, the rotary body 12, the bearings 13, the rotor 14, the anode target 35, the cathode 36, the high-voltage supply terminal 54, and the KOV member 55. The vacuum vessel 32 as a component of the vacuum envelope 31, encloses the cathode 36 and the anode target 35.

The vacuum vessel 32 comprises an X-ray transmissive window 38 in a vacuum tight state. The X-ray transmissive window 38 is provided on a wall portion of the vacuum vessel 32 opposed to an area between the cathode 36 and the anode target 35. The X-ray transmissive window 38 is formed of, for example, a metal such as beryllium, titanium, a stainless metal or aluminum, and provided at a portion opposed to the X-ray radiation window 20*w*. For example, the vacuum vessel 32 is airtightly sealed by the X-ray transmissive window 38 formed of beryllium, which is a member permitting X-rays to be transmitted therethrough. Outside of the vacuum envelope 31, the high-voltage insulating member 39 is arranged from the high-voltage supply terminal 44 side to the surrounding of the anode target 35. The high-voltage insulating member 39 is formed of an electrically insulating resin.

The vacuum vessel 32 comprises depressed portions 32*a* and 32*b*. The depressed portions 32*a* and 32*b* are formed on parts of the vacuum vessel 32, which is provided at a position opposed to the cathode 36. The parts of the vacuum vessel 32 include at least the surface of the vacuum vessel 32 which is opposed to the cathode 36 along the tube axis TA. The depressed portions 32*a* and 32*b* are depressions formed on parts of the vacuum vessel 32 to contain magnetic poles 68*a* and 68*b* of a first magnetic deflector 60 to be explained later, and are parts of the vacuum vessel 32 surrounding the depressions. For example, the depressed portions 32*a* and 32*b* are formed by depressing the vacuum vessel 32 from the outside so as to sandwich the cathode. In other words, wall surfaces of the depressed portions 32*a* and 32*b* are formed to protrude toward the cathode 36 as observed from the inside of the vacuum vessel 32. The depressed portions 32*a* and 32*b* are formed not to be so much close to the surface of the anode target 35 and the surface of the cathode 36 to prevent discharge. For example, the depressed portion 32*a* is depressed up to a position farther from the surface of the anode target 35 than from the surface of the cathode 36 opposed to the surface of the anode target 35, in the direction along the tube axis TA. Alternatively, the depressed portion 32*a* is depressed up to a position which is the same as the surface of the cathode 36 opposed to the surface of the anode target 35, or a position slightly closer to the surface of the anode target 35 than to the surface of the cathode 36 opposed to the surface of the anode target 35, in the direction along the tube axis TA.

In addition, in the depressed portions 32*a* and 32*b*, corner portions protruding toward the anode target 35 side are formed to be inclined so as to be remote from the target surface of the anode target 35 and the surface of the cathode 36 for the purpose of preventing occurrence of discharge, etc. For example, a corner portion of the depressed portion 32*a* is formed at an angle of inclination corresponding to an angle of inclination of an end surface of the magnetic pole 68*a* to be explained later. Similarly, a corner portion of the depressed portion 32*b* is formed at an angle of inclination corresponding to an angle of inclination of an end surface of the magnetic pole 68*b* to be explained later. The corner portions of the depressed portions 32*a* and 32*b* may be smoothly curved. For example, each of the corner portions of the depressed portions 32*a* and 32*b* is formed to have a predetermined diameter. Each of the corner portions of the depressed portions 32*a* and 32*b* protruding toward the anode target 35 side may not be formed to have an inclination or a diameter. Alternatively, depressed portions may be formed as one body in the rotary direction, around the cathode 36, or the number of depressed portions corresponding to the number of magnetic poles to be explained later may be formed.

The vacuum vessel 32 captures a recoil electron reflected from the anode target 35. For this reason, vacuum vessel 32 is formed of a member whose temperature can not easily be raised due to impulse of the recoil electron, such as copper having a high thermal conductance. In the present embodiment, however, the vacuum vessel 32 should desirably be formed of a member which does not generate a diamagnetic field since the vacuum envelope 31 is influenced by the alternating magnetic field generated by the magnetic poles 68*a* and 68*b* to be explained later. For example, the vacuum vessel 32 is formed of a non-magnetic metal member. The non-magnetic metal member is, for example, copper, molybdenum, a non-magnetic stainless steel, Inconel, Inconel X, titanium, conductive ceramic, non-conductive ceramic having a surface coated with a metal thin film, etc. Suitably, the vacuum vessel 32 is formed of a non-magnetic, high-electric-resistance member to prevent an eddycurrent from being generated by the AC current. More suitably, in the vacuum vessel 32, the depressed portions 32*a* and 32*b* are formed of a non-magnetic, high-electric-resistance member, and portions other than the depressed portions 32*a* and 32*b* are formed of a non-magnetic member such as copper having a high thermal conductance.

The high-voltage insulating member 39 is formed in an annular shape having one of ends shaped in a cone and the other end sealed. The high-voltage insulating member 39 is fixed to the housing 20 directly or indirectly via the stator coil 8 to be explained later. The high-voltage insulating member 39 produces electrical insulation between the fixed shaft 11, and the housing 20 and the stator coil 8. For this reason, the high-voltage insulating member 39 is provided between the stator coil 8 and the fixed shaft 11. In other words, the high-voltage insulating member 39 is provided to contain the protrusion side of the fixed axis 11.

In FIG. 1, the stator coil 8 is fixed to the housing 20 at a plurality of portions. The stator coil 8 is provided to surround an outer peripheral portion of the rotor 14 and the high-voltage insulating member 39. The stator coil 8 rotates the rotor 14, the rotary body 12 and the anode target 35. Since a magnetic field to be applied to the rotor 14 is generated by supplying a predetermined current to the stator coil 8, the anode target 35, etc., are rotated at a predetermined speed. In other words, the rotor 14 is rotated, and the anode target 35 is rotated in accordance with the rotation of the rotor 14, by supplying a current to the stator coil 8 serving as a rotation driver.

A space surrounded by the rubber bellows 2*b*, the housing 20*e*, the lid portion 20*f*, and the receptacles 301 and 302, inside the housing 20 is filled with the insulating oil 9. The insulating oil 9 absorbs at least part of the heat generated by the X-ray tube 30.

The first magnetic deflector 60 will be explained with reference to FIG. 2A to FIG. 2C.

As shown in FIG. 2B, the first magnetic deflector 60 comprises a coil 64, a yoke 66, and the magnetic poles 68*a* and 68*b*. The first magnetic deflector 60 generates a magnetic field which intermittently or sequentially deflects the orbital of the electrons emitted from the filament contained in the cathode 36. The first magnetic deflector 60 deflects the electrons (beams) emitted from the cathode 36, in a direction along the diameter direction of the anode target 35. The paired magnetic poles 68*a* and 68*b*, which will be explained in detail later, are formed at the respective ends of the yoke 66, respectively, in the first magnetic deflector 60. The first magnetic deflector 60 may comprise a plurality of magnetic poles. The magnetic poles include at least a pair of magnetic poles that generate a magnetic field therebetween and are paired as a dipole. The magnetic poles that generate a magnetic field therebetween and are paired as a dipole are often hereinafter explained as a magnetic pole pair.

In addition, in the first magnetic deflector 60, a current supplied from a deflection power supply (not shown) is controlled by a deflection power supply controller (not shown). The first magnetic deflector 60 can move a position of the focus, i.e., a point with which the electrons (beams) collide, intermittently or sequentially, on the surface of the anode target 35, by allowing the supplied current to be controlled. In the present embodiment, the first magnetic deflector 60 is supplied with an AC current from a deflection power supply (not shown). In this case, the first magnetic deflector 60 generates an alternating magnetic field. As shown in FIG. 2B, for example, the first magnetic deflector 60 generates alternating magnetic field MG1.

The coil 64 is supplied with the current from the deflection power supply (not shown) for the first magnetic deflector 60 and generates the magnetic field. The coil 64 is wound round a part of the yoke 66. For example, the coil 64 is wound in lateral symmetry, from the center of the yoke 66.

The yoke 66 is formed in a bracket shape. For example, the yoke 66 is provided such that a straight line along the tube axis TA passes through the center of the yoke 66. In the present embodiment, two distal portions of the yoke 66 are provided in close vicinity to the depressed portions 32*a* and 32*b*, respectively. At this time, the yoke 66 is provided to sandwich the cathode 36 between two distal portions. In addition, the coil 64 is wound round a part of the yoke 66.

The yoke 66 is formed of a soft magnetic material and highly electric resistor in which an eddy current can hardly be generated by the alternating magnetic field. The yoke 66 is formed by, for example, a laminate in which thin plates formed of an Fe—Si alloy (silicon steel), an Fe—Al alloy, an electromagnetic stainless steel, an Fe—Ni high-magnetic-permeability alloy such as permalloy, a Ni—Cr alloy, an Fe—Ni—Cr alloy, an Fe—Ni—Co alloy, an Fe—Cr alloy, or the like, are sandwiched by an electrically insulating film and are layered, or an assembly formed by covering wire rods of above-explained materials with an electrically insulating film and bundling the wire rods, etc. The yoke 66 may be formed of an assembly formed by grinding above-explained materials to fine powder having a diameter of approximately 1 covering the powder surface with an electrically insulating film, and molding the powder by compression molding. Furthermore, the yoke 66 may be formed of soft ferrites, etc.

The magnetic poles 68*a* and 68*b* are provided at end portions of the yoke 66, respectively. The magnetic poles 68*a* and 68*b* are provided so as to sandwich the cathode 36 between the magnetic poles. In other words, in the first magnetic deflector 60, each of the magnetic poles 68*a* and 68*b* is provided on a straight line along a direction perpendicular to the emission direction of the electrons emitted from the filament included in the cathode 36.

Suitably, to increase the magnetic flux density, each of the magnetic poles 68*a* and 68*b* is provided to be close to the emission direction (electron orbital) of the electrons emitted from the filament included in the cathode 36. In other words, the magnetic pole 68*a* is provided in close vicinity to the corner portion of the depressed portion 32*a* while the magnetic pole 68*b* is provided near the corner portion of the depressed portion 32*b*. For example, the surface of the end portion (end surface) of the magnetic pole 68*a* is formed in accordance with the inclination of the corner portion of the depressed portion 32*a* which protrudes toward the anode target 35 side. In this case, the magnetic pole 68*a* is provided such that the end surface of the magnetic pole 68*a* corresponds to the inclination of the corner portion of the depressed portion 32*a*. Similarly, the end surface of the magnetic pole 68*b* is formed in accordance with the inclination of the corner portion of the depressed portion 32*b* which protrudes toward the anode target 35 side. In this case, the magnetic pole 68*b* is provided such that the end surface of the magnetic pole 68*b* corresponds to the inclination of the corner portion of the depressed portion 32*b*.

The magnetic pole pair 68*a* and 68*b* (first magnetic pole pair) are formed in a substantially similar shape. The magnetic pole pair 68*a* and 68*b* (first magnetic pole pair) are paired as a dipole. The magnetic pole pair 68*a* and 68*b* are provided to face the surfaces (end surfaces) toward the electron emission direction of the cathode 36 to deflect the electrons emitted from the cathode 36 at positions which are not so close to the anode target 35. In other words, the surface of the magnetic pole 68*a* is formed to be inclined toward the straight line along the electron emission direction. Similarly, the surface of the magnetic pole 68*b* is formed to be inclined toward the straight line along the electron emission direction. For example, the emission direction of the electron beam of the cathode 36 is the direction along the tube axis TA. At this time, the magnetic poles 68*a* and 68*b* are provided to be inclined at the same angle to the electron emission direction. As shown in FIG. 2B, the angle from the electron emission direction along the tube axis TA to the surface of the magnetic pole 68*a* is represented by yl and the angle from the electron emission direction to the surface of the magnetic pole 68*b* is represented by γ2. Thus, γ1 is equal to γ2 if, for example, the magnetic poles 68*a* and 68*b* are provided to be inclined similarly. In addition, angles of inclination γ (γ1 and γ2) to the electron emission direction, of the magnetic poles 68*a* and 68*b*, are set within a range of $0°<\gamma<90°$. At this time, each of angles of inclination γ of the magnetic poles 68*a* and 68*b* is formed to fall within the range of $0°<\gamma<90°$. For example, if angles of inclination γ1 and γ2 of the magnetic poles 68*a* and 68*b* are equal to each other, each of angles of inclination γ1 and γ2 of the magnetic poles 68*a* and 68*b* is formed within a range of $30°\leq\gamma\leq60°$. Furthermore, each of angles of inclination γ1 and γ2 of the magnetic poles 68*a* and 68*b* may be formed to be 45° to the electron emission direction. It should be noted that a plurality of magnetic pole pairs may be provided in the first magnetic deflector 60.

In the present embodiment, the electrons are emitted from the filament in the cathode 36 toward the focus of the electrons of the anode target 35 when the X-ray tube assembly 1 is driven. The direction of emission of the electrons is assumed to be along a straight line which passes through the center of the cathode 36. In addition, angles of inclination γ1 and γ2 of the magnetic poles 68*a* and 68*b* of the first magnetic deflector 60 shown in FIG. 2B are equal to each other. The first magnetic deflector 60 is supplied with an AC current from a deflection power supply (not shown). When the first magnetic deflector 60 is supplied with an AC current, the first magnetic deflector 60 generates a magnetic field between the magnetic pole pair 68*a* and 68*b* which are paired as a dipole. In the present embodiment, the magnetic pole pair 68*a* and 68*b* are provided to generate the magnetic fields between the cathode 36 and the anode target 35. In other words, the first magnetic deflector 60 generates a magnetic field between the cathode 36 and the anode target 35. The electrons emitted from the cathode 36 collide with the anode target 35 so as to cross the magnetic field generated between the cathode 36 and the anode target 35, along the tube axis TA.

The first magnetic deflector 60 can move the electron beams passing through the magnetic field, intermittently or sequentially, by allowing the AC current supplied from the deflection power supply (not shown) to be controlled. The first magnetic deflector 60 deflects the electrons (beams) emitted from the cathode 36, in the direction along the diameter direction of the anode target 35, by controlling the current supplied from the deflection power supply controller (not shown). In other words, the first magnetic deflector 60 can move the position of the focus, i.e., the point with which the electrons collide on the surface of the anode target 35, by controlling the current supplied by the deflection power supply controller (not shown). In the present embodiment, the first magnetic deflector 60 can move the electron beams in the direction perpendicular to the magnetic field. For example, the first magnetic deflector 60 moves the electron beams in two directions perpendicular to the alternating magnetic field MG1, similarly to direction D1 shown in FIG. 2C.

When the first magnetic deflector 60 generates the alternating magnetic field MG1, the non-magnetic cover of the cathode 36 allows the magnetic field to be generated in the direction opposite to the alternating magnetic field MG1, based on the eddy current, since the non-magnetic cover is formed of a non-magnetic material having high electrical conductivity. Similarly, the anode target 35 allows the magnetic field to be generated in the direction opposite to the alternating magnetic field MG1, based on the eddy current, since the anode target 35 is formed of a non-magnetic material having high electrical conductivity. The alternating magnetic field MG1 is distorted by actions of the magnetic fields in the opposite direction as generated from the non-magnetic cover and the anode target 35. By thus distorting the alternating magnetic field MG1, the alternating magnetic field MG1 flows in the direction substantially perpendicular to the electron emission direction, at a position between the surface of the anode target 35 and the surface of the cathode 36 as shown in FIG. 2B. In addition, by thus distorting the alternating magnetic field MG1, the strength (magnetic flux density) of the alternating magnetic field MG1 in the area close to the position between the surface of the anode target 35 and the surface of the cathode 36 is increased. As a result, the deflecting force to the electrons (beams) is increased by increasing the magnetic flux density, and the first magnetic deflector 60 can efficiently deflect the electrons (beams).

In the present embodiment, the X-ray tube assembly 1 comprises the X-ray tube 30 comprising the depressed portions 32*a* and 32*b*, and the first magnetic deflector 60 which deflects the electrons emitted from the X-ray tube 30. The first magnetic deflector 60 allows a magnetic field to be generated between the cathode 36 and the anode target 35 by the magnetic poles 68*a* and 68*b*. Each of the magnetic pole pair 68*a* and 68*b* is provided to face the surface toward the electron emission direction, with the predetermined inclination, to deflect the electrons emitted from the cathode 36 at the position between the anode target 35 and the cathode 36. The cathode 36 comprises a non-magnetic cover formed of a non-magnetic metal member having high electrical conductivity, at a peripheral portion thereof, inside the vacuum envelope 31 of the X-ray tube 30. In addition, the anode target 35 is also formed of a non-magnetic metal member having high electrical conductivity. Thus, when the first magnetic deflector 60 is provided with the AC current, a part of the alternating magnetic field MG1 generated by the first magnetic deflector 60 is strengthened. As a result, the first magnetic deflector 60 can certainly deflect the electrons emitted from the cathode 36.

In addition, in the X-ray tube assembly 1, the distance between the anode target 35 and the cathode 36 can be reduced since a small-diameter portion is not provided between the anode target 35 and the cathode 36. As a result, occurrence of expansion, blur, and distortion of the X-ray focus, reduction in the electron emission quantity of the cathode 36, etc., can be reduced in the X-ray tube assembly 1 of the present embodiment.

Next, an X-ray tube assembly of another embodiment will be explained. In another embodiment, portions like or similar to those of the above-explained first embodiment are denoted by the same reference numbers or symbols and detailed descriptions are omitted.

Second Embodiment

An X-ray tube assembly 1 of the second embodiment is different from the X-ray tube assembly 1 of the first embodiment with respect to the depressed portions 32*a* and 32*b* and the first magnetic deflector 60.

Figure 3:
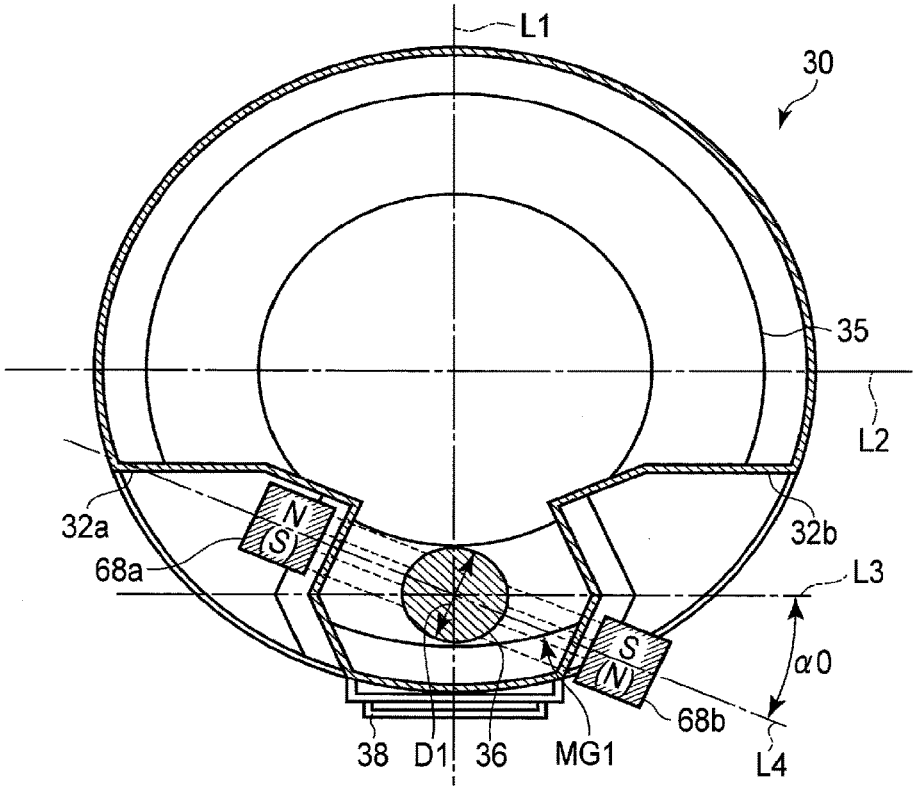
FIG. 3 is a cross-sectional view showing a summary of an X-ray tube of a second embodiment.

FIG. 3 is a cross-sectional view showing a summary of an X-ray tube 30 of the second embodiment. In FIG. 3, a straight line orthogonal to tube axis TA is referred to as straight line L1, a straight line orthogonal to the tube axis TA and straight line L1 is referred to as straight line L2, and a straight line which is orthogonal to a straight line along an electron emission direction and straight line L1 and which is parallel to straight line L2 is referred to as straight line L3. In addition, a straight line drawn to be inclined at angle αO to straight line L3, around the straight line along the electron emission direction is referred to as straight line L4. The straight line along the electron emission direction is assumed to pass through the center of the cathode 36.

As shown in FIG. 3, each of depressed portions 32*a* and 32*b* comprises a wall portion bent to surround the cathode 36, in the X-ray tube 30 of the second embodiment. The wall portions of the depressed portions 32*a* and 32*b* opposes to each other on a straight line orthogonal to the straight line along the electron emission direction. The wall portions of the depressed portions 32*a* and 32*b* may not be bent to surround the cathode 36.

For example, as shown in FIG. 3, the depressed portion 32*a* comprises the wall portion which perpendicularly intersects straight line L4 and which is opposed to the cathode 36. Similarly, the depressed portion 32*b* comprises the wall portion which perpendicularly intersects straight line L4 and which is opposed to the cathode 36. The wall portions of the depressed portions 32*a* and 32*b* are provided on straight line L4 to be opposed to each other.

The first magnetic deflector 60 is provided to rotate at a predetermined angle around the straight line along the direction of emission of the electron beam. For example, as shown in FIG. 3, the first magnetic deflector 60 is provided to be inclined parallel to straight line L4. In this case, the magnetic poles 68*a* and 68*b* of the first magnetic deflector 60 are provided to sandwich the cathode 36 on straight line L4.

In the present embodiment, the first magnetic deflector 60 can deflect the electron beam, simultaneously, in a diameter direction and a direction of rotation of the anode target 35, by alternating magnetic field MG1 generated by the paired magnetic poles 68*a* and 68*b*. In other words, the first magnetic deflector 60 can move a focus of the electron beam at a rate tan αO of the distance of movement in the direction of rotation to the distance of movement in the diameter direction, of the anode target. Generally the shape of the focus, viewed through the X-ray transmissive window 38 along the straight line orthogonal to the tube axis TA and intersecting with the center of the focus, is referred to as the effective focus. If the focus moves in the diameter direction by x, then the effective focus moves in the tube axis direction by x tan θ. On the other hand, if the focus moves in the direction of rotation by y(=x tan αO), then the effective focus moves in the direction of rotation by the same extent, y(=x tan αO).

For example, to move the effective focus in an equal distance in the tube axis direction (that is the direction along the length of the effective focus) and the direction of rotation (that is the direction along the width of the effective focus), the first magnetic deflector 60 is arranged such that angle αO which is made by straight line L4 to straight line L3 is equal to angle of inclination θ of the anode target 35.

In the present embodiment, the first magnetic deflector 60 is provided to rotate at a predetermined angle around the straight line along the direction of emission of the electron beam. As a result, the first magnetic deflector 60 can deflect the electron beam emitted from the cathode 36 in a direction different from that of the first embodiment.

Third Embodiment

An X-ray tube assembly 1 of the third embodiment is different from the X-ray tube assembly 1 of the above-explained embodiment with respect to a feature of further comprising a second magnetic deflector 70.

The X-ray tube assembly 1 of the third embodiment is configured substantially equally to the X-ray tube assembly 1 of the second embodiment. In the third embodiment, portions like or similar to those of the above-explained second embodiment are denoted by the same reference numbers or symbols and detailed descriptions are omitted.

Figure 4A:
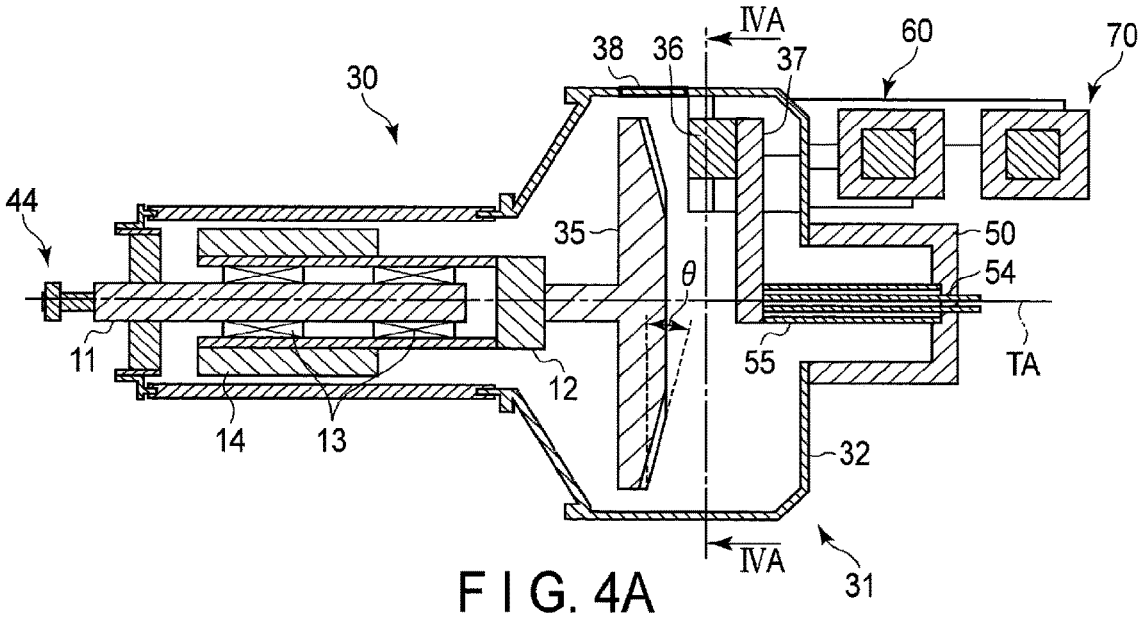
FIG. 4A is a cross-sectional view showing a summary of an X-ray tube of a third embodiment.
Figure 4B:
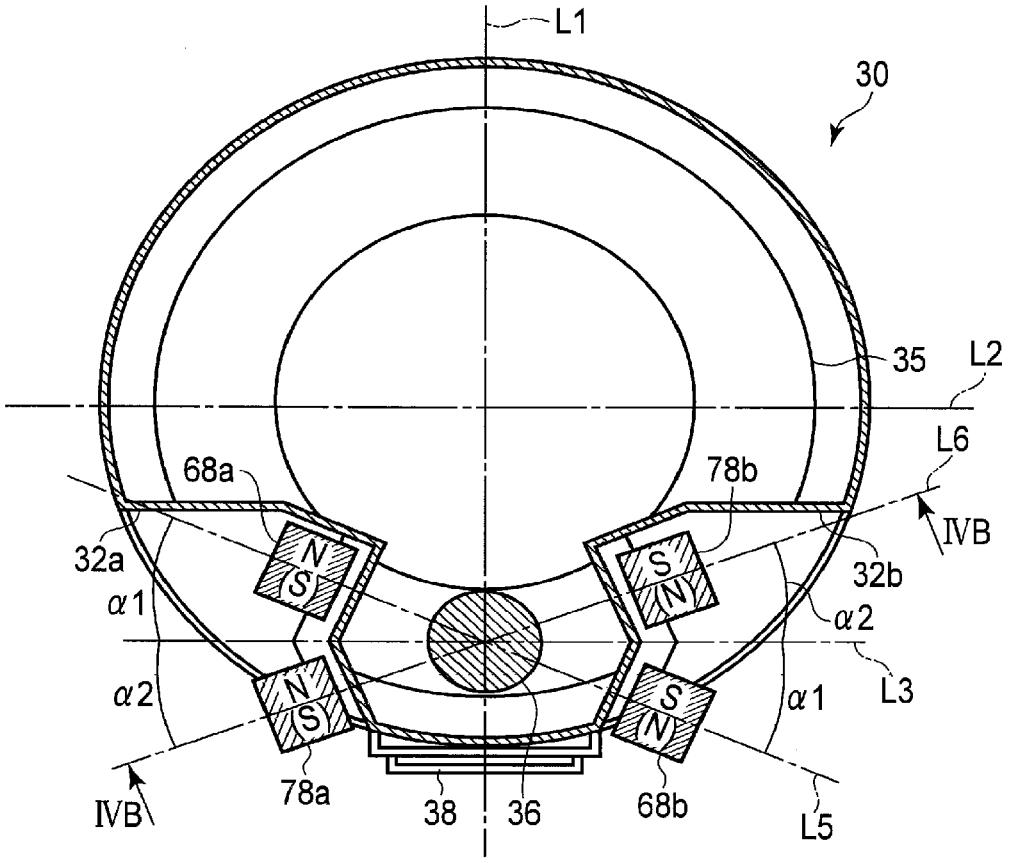
FIG. 4B is a cross-sectional view seen along line IVA-IVA in FIG. 4A.
Figure 4C:
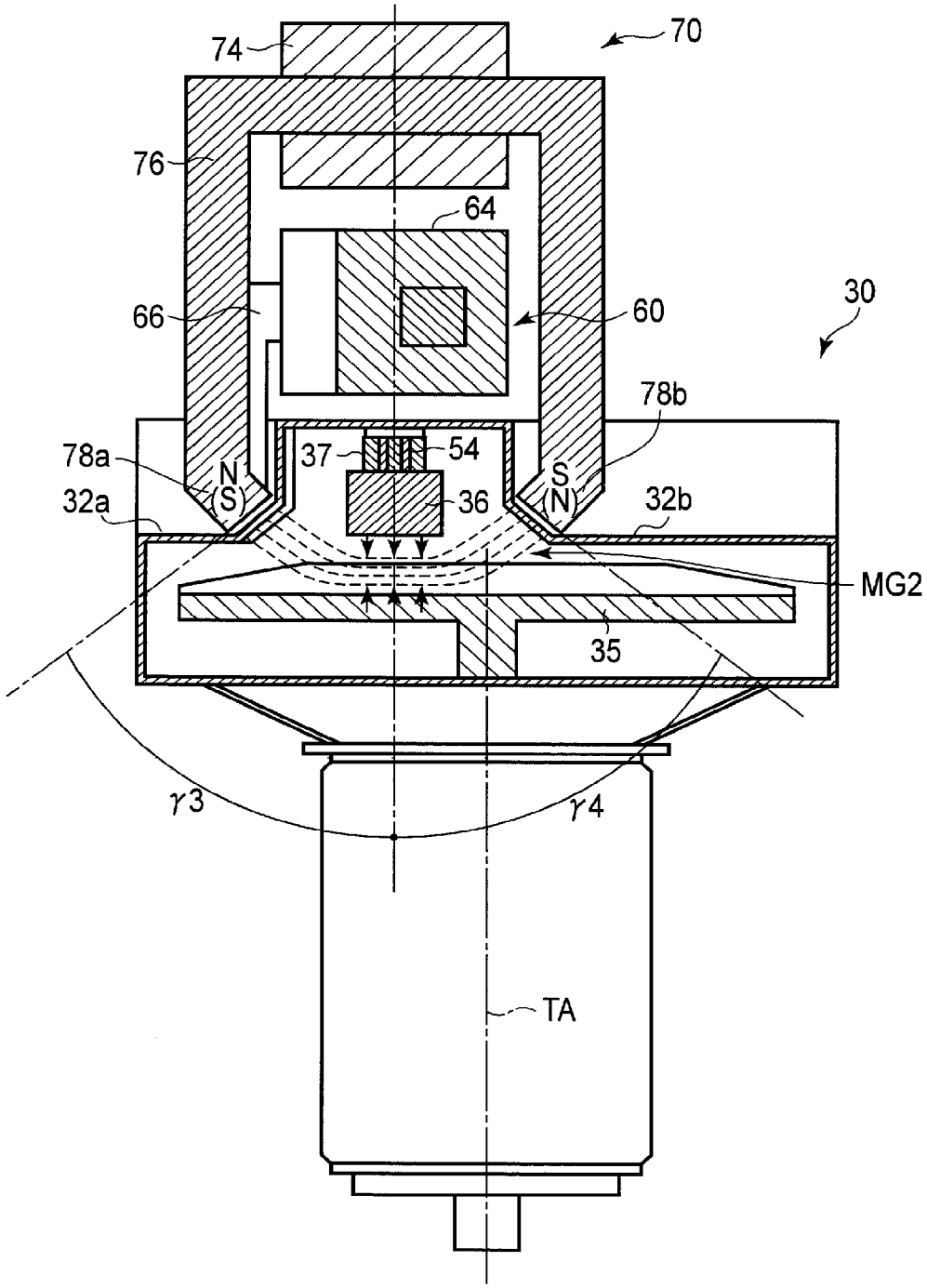
FIG. 4C is a cross-sectional view seen along line IVB-IVB in FIG. 4B.

FIG. 4A is a cross-sectional view showing a summary of an X-ray tube 30 of the third embodiment, FIG. 4B is a cross-sectional view seen along line IVA-IVA in FIG. 4A, and FIG. 4C is a cross-sectional view seen along line IVB-IVB in FIG. 4B. In FIG. 4B, a straight line orthogonal to tube axis TA is referred to as straight line L1, a straight line orthogonal to the tube axis TA and straight line L1 is referred to as straight line L2, and a straight line which is orthogonal to a straight line along an electron emission direction and straight line L1 and which is parallel to straight line L2 is referred to as straight line L3. In addition, a straight line drawn to be inclined at angle α1 to straight line L3, around the straight line along the electron emission direction is referred to as straight line L5, and a straight line drawn to be inclined at angle α2 to straight line L3, around the straight line along the electron emission direction is referred to as straight line L6. The straight line along the electron emission direction is assumed to pass through the center of the cathode 36. Angles of inclination α1 and α2 of the respective straight line L5 and straight line L6 are hereinafter set to be equal angles for convenience of explanation. Angles of inclination α1 and α2 may be different from each other.

Besides the configuration of the X-ray tube assembly 1 of the second embodiment, the X-ray tube assembly 1 of the third embodiment further comprises a second magnetic deflector 70. The second magnetic deflector 70 is configured substantially equally to the first magnetic deflector 60. As shown in FIG. 4B, a depressed portion 32*a* is formed to accept a magnetic pole 68*a* and a magnetic pole 78*a* to be explained later while a depressed portion 32*b* is formed to accept a magnetic pole 68*b* and a magnetic pole 78*b* to be explained later.

The second magnetic deflector 70 is configured substantially equally to the first magnetic deflector 60, and its detailed explanations are omitted.

As shown in FIG. 4C, the second magnetic deflector 70 comprises a coil 74, a yoke 76, and the magnetic poles 78*a* and 78*b*. In addition, as shown in FIG. 4C, the second magnetic deflector 70 forms alternating magnetic field MG2 which intermittently or sequentially deflects the orbital of the electrons emitted from a filament contained in the cathode 36. The second magnetic deflector 70 deflects the electrons (beams) emitted from the cathode 36, in a direction along the diameter direction of an anode target 35. The second magnetic deflector 70 is constituted by the paired magnetic poles 78*a* and 78*b* at both ends of the yoke 76.

The second magnetic deflector 70 is provided in close vicinity to the depressed portions 32*a* and 32*b* of the X-ray tube 30, outside the X-ray tube 30. As shown in FIG. 4A, the second magnetic deflector 70 is provided coaxially with the first magnetic deflector 60, on the straight line parallel to the tube axis TA passing through the center of the cathode 36, in the present embodiment. In addition, the second magnetic deflector 70 is provided to rotate at a predetermined angle around the straight line along the electron emission direction. For example, as shown in FIG. 4B, the first magnetic deflector 60 is provided to be inclined along straight line L5 while the second magnetic deflector 70 is provided to be inclined along straight line L6.

In the second magnetic deflector 70, a current supplied from a deflection power supply (not shown) is controlled by a deflection power supply controller (not shown). The second magnetic deflector 70 can move a position of the focus, intermittently or sequentially, on the surface of the anode target 35, by allowing the supplied current to be controlled. In the present embodiment, the second magnetic deflector 70 is supplied with an AC current from a deflection power supply (not shown). In this case, the second magnetic deflector 70 generates an alternating magnetic field. It should be noted that the deflection power supply and the deflection power supply controller may be the same as or different from those of the first magnetic deflector 60.

The magnetic poles 78*a* and 78*b* (second magnetic pole pair) are provided at end portions of the yoke 76, respectively. The magnetic poles 78*a* and 78*b* are provided such that the cathode 36 opposed to the anode target 35 is provided between the magnetic poles 78*a* and 78*b*. In other words, in the second magnetic deflector 70, the pair of magnetic poles 78*a* and 78*b* are provided on a straight line along a direction perpendicular to the emission direction of the electrons emitted from the filament included in the cathode 36 or, for example, straight line L6.

The magnetic pole pair 78*a* and 78*b* are formed in a substantially similar shape. The magnetic pole pair 78*a* and 78*b* are paired as a dipole. Similarly to the magnetic pole pair 68*a* and 68*b*, the magnetic pole pair 78*a* and 78*b* are provided to face toward the electron emission direction of the cathode 36 to deflect the electrons emitted from the cathode 36 at positions which are not so close to the anode target 35. For example, the emission direction of the electron beam of the cathode 36 is the direction along the tube axis TA. At this time, the magnetic poles 78*a* and 78*b* are provided to be inclined at the same angle to the electron emission direction. As shown in FIG. 4C, the angle from the electron emission direction along the tube axis TA to the surface of the magnetic pole 78*a* is represented by $\gamma 3$ and the angle from the electron emission direction to the surface of the magnetic pole 78*b* is represented by $\gamma 4$. Thus, $\gamma 3$ is equal to $\gamma 4$ if, for example, the magnetic poles 78*a* and 78*b* are provided to be inclined similarly. In addition, angles of inclination $\gamma$ ($\gamma 1$, $\gamma 2$, $\gamma 3$ and $\gamma 4$) to the electron emission direction, of the magnetic poles 78*a* and 78*b*, are set within a range of $0° < \gamma < 90°$. At this time, each of angles of inclination $\gamma$ of the magnetic poles 78*a* and 78*b* is formed to fall within the range of $0° < \gamma < 90°$. For example, if angles of inclination $\gamma 3$ and $\gamma 4$ of the magnetic poles 78*a* and 78*b* are equal to each other, each of angles of inclination $\gamma 3$ and $\gamma 4$ of the magnetic poles 78*a* and 78*b* is formed within a range of $30° \leq \gamma \leq 60°$. Furthermore, each of angles of inclination $\gamma 3$ and $\gamma 4$ of the magnetic poles 78*a* and 78*b* may be formed to be 45° to the electron emission direction. It should be noted that a plurality of magnetic pole pairs may be provided in the second magnetic deflector 70.

In the present embodiment, the electrons are emitted from the filament in the cathode 36 toward the focus of the electrons of the anode target 35 when the X-ray tube assembly 1 is driven. The direction of emission of the electrons is assumed to be along a straight line which passes through the center of the cathode 36. The first magnetic deflector 60 and the second magnetic deflector 70 are provided at positions at which two sets of dipoles, i.e., the magnetic pole pair 68*a* and 68*b* and the magnetic pole pair 78*a* and 78*b*, are rotated at predetermined angles $\alpha$ ($\alpha 1$ and $\alpha 2$) toward opposite sides to straight line L3, around the center axis of the cathode 36. Each of the magnetic pole pair 68*a* and 68*b* of the first magnetic deflector 60 is provided on straight line L5 that is rotated at angle $\alpha 1$ to straight line L3. Each of the magnetic pole pair 78*a* and 78*b* of the second magnetic deflector 70 is provided on straight line L5 that is rotated at angle $\alpha 2$ to straight line L3.

In addition, angles of inclination $\gamma 1$ and $\gamma 2$ of the magnetic poles 68*a* and 68*b* of the first magnetic deflector 60 are equal to angles of inclination $\gamma 3$ and $\gamma 4$ of the magnetic poles 78*a* and 78*b* of the second magnetic deflector 70. Each of the first magnetic deflector 60 and the second magnetic deflector 70 is supplied with an AC current from a deflection power supply (not shown). When the first magnetic deflector 60 is supplied with the AC current from the deflection power supply, the first magnetic deflector 60 generates alternating magnetic field MG1 between the magnetic pole pair 68*a* and 68*b* serving as a dipole. Similarly, the second magnetic deflector 70 generates alternating magnetic field MG2 between the magnetic pole pair 78*a* and 78*b* serving as a dipole. In the present embodiment, the magnetic pole pair 68*a* and 68*b*, and the magnetic pole pair 78*a* and 78*b* are provided to generate the magnetic fields between the cathode 36 and the anode target 35. The electrons emitted from the cathode 36 collide with the anode target 35 so as to cross the alternating magnetic field MG1 and/or alternating magnetic field MG2 generated between the cathode 36 and the anode target 35, along the tube axis TA.

Each of the first magnetic deflector 60 and the second magnetic deflector 70 can move the electron beam passing through the magnetic field, intermittently or sequentially, by allowing the AC current supplied from the deflection power supply (not shown) to be controlled.

The X-ray tube assembly 1 of the present embodiment can move the focus with which the electrons collide, on the anode target 35, simultaneously, in the diameter direction and the direction of rotation, by deflecting magnetic fields generated by two sets of the paired magnetic poles 68*a* and 68*b* and the paired magnetic poles 78*a* and 78*b*.

The first magnetic deflector 60 can deflect the electron beam, simultaneously, in the diameter direction and the direction of rotation of the anode target 35, by alternating magnetic field MG1 generated by the paired magnetic poles 68*a* and 68*b*. In addition, the second magnetic deflector 70 can deflect the electron beam, simultaneously, in the diameter direction and the direction of rotation of the anode target 35, by alternating magnetic field MG2 generated by the paired magnetic poles 78*a* and 78*b*. In other words, the first magnetic deflector 60 and the second magnetic deflector 70 can move the focus of the electron beam, at a predetermined rate of the distance of movement in the direction of rotation to the distance of movement in the diameter direction, of the anode target 35. The predetermined rate can be selected within the range between 0 and tan $\alpha$, by adjusting the ratio of the magnetic field strength of MG1 and the magnetic field strength of MG2.

In the present embodiment, the X-ray tube assembly 1 comprises the first magnetic deflector 60 and the second magnetic deflector 70. As a result, the first magnetic deflector 60 and the second magnetic deflector 70 can freely move the focus of the electron beam on the anode target 35, by adjusting the rate of their respective magnetic field strengths.

Fourth Embodiment

An X-ray tube assembly 1 of the fourth embodiment is different from the X-ray tube assembly 1 of the above-explained embodiment with respect to structures of a first magnetic deflector 60 and a second magnetic deflector 70.

The X-ray tube assembly 1 of the fourth embodiment is configured substantially equally to the X-ray tube assembly 1 of the third embodiment. Thus, in the fourth embodiment, portions like or similar to those of the above-explained third embodiment are denoted by the same reference numbers or symbols and detailed descriptions are omitted.

Figure 5A:
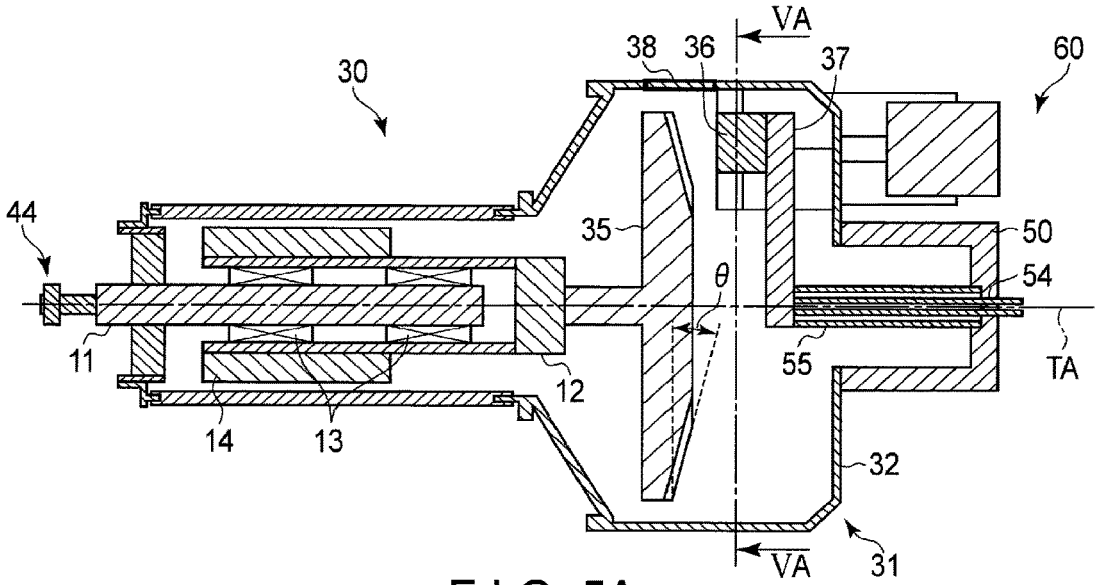
FIG. 5A is a cross-sectional view showing a summary of the X-ray tube of a fourth embodiment.
Figure 5B:
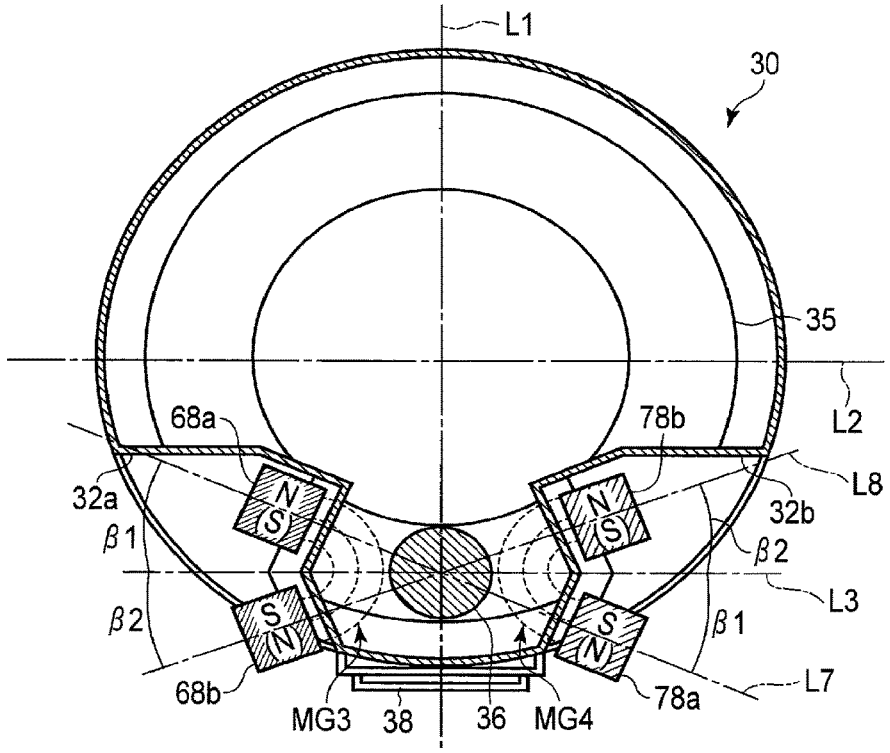
FIG. 5B is a cross-sectional view seen along line VA-VA in FIG. 5A.

FIG. 5A is a cross-sectional view showing a summary of an X-ray tube 30 of the fourth embodiment and FIG. 5B is a cross-sectional view seen along line VA-VA of FIG. 5A. In FIG. 5B, a straight line orthogonal to tube axis TA is referred to as straight line L1, a straight line orthogonal to the tube axis TA and straight line L1 is referred to as straight line L2, and a straight line which is orthogonal to a straight line along an electron emission direction and straight line L1 and which is parallel to straight line L2 is referred to as straight line L3. In addition, a straight line drawn to be inclined at angle β1 to straight line L3, around the straight line along the electron emission direction is referred to as straight line L7, and a straight line drawn to be inclined at angle β2 to straight line L3, around the straight line along the electron emission direction is referred tows straight line L8. The straight line along the electron emission direction is assumed to pass through the center of the cathode 36. Angles of inclination β1 and β2 of the respective straight line L7 and straight line L8 are hereinafter set to be equal angles, for convenience of explanation. Angles of inclination β1 and β2 may be different from each other.

In the X-ray tube assembly 1 of the fourth embodiment, the first magnetic deflector 60 is provided to be rotated at 90 degrees to the installation of the first magnetic deflector 60 of the first embodiment. For example, as shown in FIG. 5A, the first magnetic deflector 60 is provided such that both end portions (magnetic poles 68*a* and 68*b*) of a yoke 66 are contained in a depressed portion 32*a*. Similarly, the second magnetic deflector 70 is provided such that both end portions (magnetic poles 78*a* and 78*b*) of a yoke 76 are contained in a depressed portion 32*b*.

For example, as shown in FIG. 5B, the magnetic poles 68*a* and 68*b* are arranged parallel to straight line L1 and provided in the depressed portion 32*a* while the magnetic poles 78*a* and 78*b* are arranged parallel to straight line L1 and provided in the depressed portion 32*b*. At this time, the magnetic poles 68*a* and 78*a* are provided to sandwich the cathode 36 on straight line L7 while the magnetic poles 68*b* and 78*b* are provided to sandwich the cathode 36 on straight line L8.

In the present embodiment, the electrons are emitted from the filament in the cathode 36 toward the focus of the electrons of the anode target 35 when the X-ray tube assembly 1 is driven. The direction of emission of the electrons is assumed to be along a straight line which passes through the center of the cathode 36. The magnetic poles 68*a* and 68*b* are contained in the depressed portion 32*a*. Similarly, the magnetic poles 78*a* and 78*b* are provided to be contained in the depressed portion 32*b*.

Each of the first magnetic deflector 60 and the second magnetic deflector 70 is supplied with an AC current from a deflection power supply (not shown). When the first magnetic deflector 60 is supplied with the AC current from the deflection power supply, the first magnetic deflector 60 generates alternating magnetic field MG1 between the magnetic pole pair 68*a* and 68*b* serving as a dipole. Similarly, the second magnetic deflector 70 generates alternating magnetic field MG2 between the magnetic pole pair 78*a* and 78*b* serving as a dipole. At this time, the magnetic poles 68*a* and 68*b* generate alternating magnetic field MG3 in a diameter direction of the anode target 35. The magnetic poles 78*a* and 78*b* generate alternating magnetic field MG4 in a diameter direction of the anode target 35, on a side opposite to the magnetic poles 68*a* and 68*b* with the cathode 36 interposed therebetween. In the present embodiment, the magnetic pole pair 68*a* and 68*b*, and the magnetic pole pair 78*a* and 78*b* are provided to generate the magnetic fields between the cathode 36 and the anode target 35.

Each of the first magnetic deflector 60 and the second magnetic deflector 70 can move the electron beam passing through the magnetic field, intermittently or sequentially, by allowing the AC current supplied from the deflection power supply (not shown) to be controlled. Each of the first magnetic deflector 60 and the second magnetic deflector 70 deflects the electrons (beam) emitted from the cathode 36, in the direction along the direction of rotation of the anode target 35, by controlling the current supplied from the deflection power supply controller (not shown). In other words, the first magnetic deflector 60 and the second magnetic deflector 70 can move the focus of the electron beam on the anode target 35, in the direction along the direction of rotation of the anode target 35.

According to the present embodiment, the first magnetic deflector 60 is provided such that the magnetic poles 68*a* and 68*b* are contained in the depressed portion 32*a*. Similarly, the second magnetic deflector 70 is provided such that the magnetic poles 78*a* and 78*b* of the yoke 76 are contained in the depressed portion 32*b*. As a result, the first magnetic deflector 60 and the second magnetic deflector 70 can deflect the electrons (beam) emitted from the cathode 36, in the direction along the direction of rotation of the anode target 35.

According to the above-explained embodiment, the X-ray tube assembly comprises the X-ray tube comprising the depressed portions, and the magnetic deflectors which deflect the electrons emitted from the X-ray tube. Each of the magnetic deflectors comprises a plurality of magnetic poles. The magnetic poles include at least a magnetic pole pair serving as a dipole. The magnetic pole pair allow the magnetic field to be generated between the cathode and the anode target. Each of the magnetic poles included in the magnetic pole pair has the surface face to the electron emission direction, to deflect the electrons emitted from the cathode at the position between the anode target and the cathode. The cathode comprises, for example, a non-magnetic cover formed of a non-magnetic metal member having high electrical conductivity, at a peripheral portion thereof, inside the vacuum envelope of the X-ray tube. In addition, the anode target is also formed of, for example, a non-magnetic metal member having high electrical conductivity. Thus, when each magnetic deflector is provided with the AC current, a part of the magnetic field generated by the magnetic deflector is strengthened. As a result, the magnetic deflector can certainly deflect the electrons emitted from the cathode.

In addition, in the X-ray tube assembly, the distance between the anode target and the cathode can be reduced since a small-diameter portion is not provided between the anode target and the cathode. As a result, occurrence of expansion, blur, and distortion of the X-ray focus, reduction in the electron emission quantity of the cathode, etc., can be reduced in the X-ray tube assembly 1 of the present embodiment.

In the above-explained embodiments, the X-ray tube assembly 1 is a rotary-anode X-ray tube assembly, but may be a stationary-anode X-ray tube assembly.

In the above-explained embodiments, the X-ray tube assembly 1 is a neutral-grounding-type X-ray tube assembly, but may be an anode-grounding or cathode-grounding X-ray tube assembly.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An X-ray tube assembly, comprising:

a cathode emitting an electron and comprising at least a surface portion formed of a first non-magnetic metal member having high electrical conductivity, an anode target comprising at least a surface portion formed of a second non-magnetic metal member having high electrical conductivity, being provided to be opposed to the cathode, and comprising a target surface from which X rays are generated by allowing the electron emitted from the cathode to collide with the target surface;

a vacuum envelope containing the cathode and the anode target, having an interior sealed in vacuum airtight state, and having at least one depressed portion depressed from outside formed to sandwich the cathode from both sides; and a first magnetic deflector supplied with an AC current from a power supply, provided outside the vacuum envelope, comprising at least one first magnetic pole pair composed of two paired magnetic poles generating the alternating magnetic field, and generating an alternating magnetic field for deflecting an electron orbital of the electron emitted from the cathode toward the anode target, between the cathode and the anode target, by the first magnetic pole pair, wherein the first magnetic pole pair is provided in close vicinity to a wall surface of the depressed portion so as to sandwich the cathode and is provided such that an angle of an end surface of each of the magnetic poles to the electron orbital is a predetermined angle of inclination $\gamma$, and the angle of inclination $\gamma$ is in a range of $0° < \gamma < 90°$.

2. The X-ray tube assembly of claim 1, wherein the depressed portion is provided at a position farther from the anode target than the end surface of the cathode in a direction according to the electron orbital.

3. The X-ray tube assembly of claim 1, wherein the first magnetic pole pair are provided to be rotatable at a predetermined angle, around the electron orbital.

4. The X-ray tube assembly of claim 1, further comprising:

a second magnetic deflector supplied with an AC current from a power supply, provided outside the vacuum envelope, comprising at least one second magnetic pole pair composed of two paired magnetic poles provided to sandwich the cathode at positions different from the fist magnetic pole pair, and generating an alternating magnetic field between the cathode and the anode target by the first magnetic pole pair.

5. The X-ray tube assembly of claim 4, wherein the second magnetic pole pair is provided such that an angle of an end surface of each of the magnetic poles to the electron orbital is the angle of inclination $\gamma$.

6. The X-ray tube assembly of claim 1, wherein each of the first metal member and the second metal member is a metal member containing any one or some of copper, tungsten, molybdenum, niobium, tantalum, and a non-magnetic stainless steel, titanium, chromium as major components.

* * * * *